United States Patent [19]

Thouron et al.

[11] Patent Number: 4,930,422

[45] Date of Patent: Jun. 5, 1990

[54] EJECTABLE, IMPERVIOUSLY SEALING DEVICE ESPECIALLY FOR ROCKETS WITH MUNITIONS

[75] Inventors: René Thouron, La Ferte St Aubin; Jean-Francois Denis, Checy, both of France

[73] Assignee: Thomson-Brandt Armements, Boulogne-Billancourt, France

[21] Appl. No.: 198,091

[22] Filed: May 24, 1988

[30] Foreign Application Priority Data

May 26, 1987 [FR] France ..... 87 07421

[51] Int. Cl.[5] ..... F42B 15/10

[52] U.S. Cl. ..... 102/378; 102/490; 102/293; 244/3.1

[58] Field of Search ..... 102/378, 490, 293, 356; 244/3.1

[56] References Cited

U.S. PATENT DOCUMENTS

| | | | |
|---|---|---|---|
| 3,177,655 | 4/1965 | White | 102/378 X |
| 3,260,204 | 7/1966 | Wilkey, Jr. | 102/378 X |
| 3,633,456 | 1/1972 | Carr et al. | 102/378 X |
| 4,455,943 | 6/1984 | Pinson | 102/378 X |
| 4,665,825 | 5/1987 | Petersson | 102/378 X |
| 4,699,062 | 10/1987 | Lewis et al. | 102/378 X |

FOREIGN PATENT DOCUMENTS

| | | |
|---|---|---|
| 114602 | 8/1984 | European Pat. Off. . |
| 121481 | 10/1984 | European Pat. Off. . |
| 2920347 | 11/1980 | Fed. Rep. of Germany . |
| 2117697 | 2/1972 | France . |
| 2143063 | 2/1973 | France . |
| 2146956 | 9/1974 | France . |
| 2111646 | 10/1974 | France . |

*Primary Examiner*—Peter A. Nelson
*Attorney, Agent, or Firm*—Roland Plottel

[57] ABSTRACT

A device for the impervious sealing of a structure, for example a munitions compartment of a rocket, is disclosed. This device comprises an elastic shaped section inside which the edge of the structure and rim of a lid are imperviously embedded. This device further has means for thrusting the lid outwards from the structure. This thrust pushes the rim and/or the edge out of the shaped section through the deformation of this elastic shaped section, and causes the total expulsion of lid. When the device is fitted into a rocket, the moving away of the rim modifies the aerodynamic drag coefficient (Cx) of the rocket. This difference in Cx causes the total expulsion of the lid and thus causes the structure to be opened.

8 Claims, 3 Drawing Sheets

FIG_2
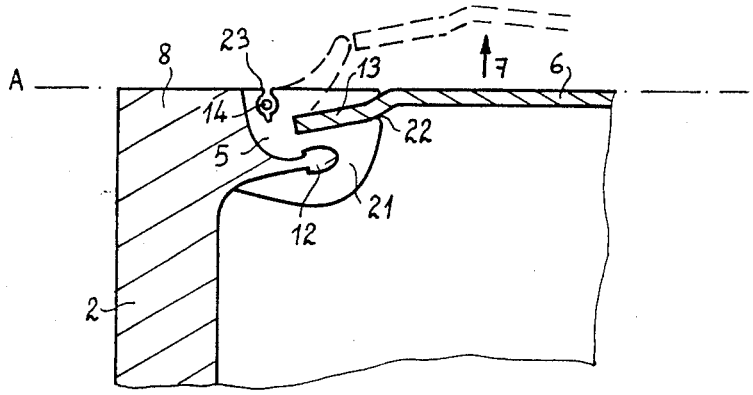
FIG_3
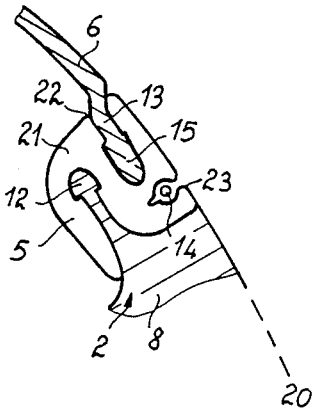
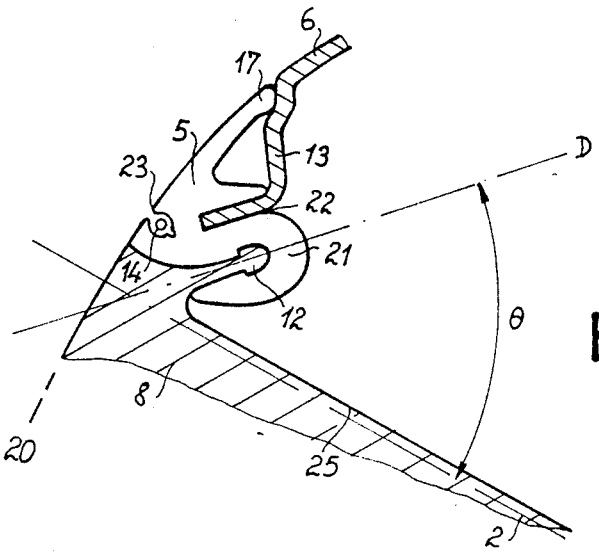
FIG_4

EJECTABLE, IMPERVIOUSLY SEALING DEVICE ESPECIALLY FOR ROCKETS WITH MUNITIONS

BACKGROUND OF THE INVENTION

1. Field of the Invention

The present invention relates to an imperviously sealing, ejectable device for a structure constituting, for example, a munitions compartment of a rocket. The opening of the compartment, on command, enables the ejection of the munitions at the desired time.

In current military strategy for neutralizing vital enemy installations, such as landing areas, there are two stages:

In the first stage, a rocket with munitions is either sent by a launching tube or released by an aircraft above the zone to be neutralized;

In the second stage, the munitions are ejected upon a command.

The munitions are, for example, placed in compartments which should be closed by ejectable devices. Devices of this type should, furthermore, be imperviously sealed because military equipment is sometimes stored for long periods and should withstand damp and wet conditions.

2. Description of the Prior Art

There are known imperviously sealing, ejectable devices designed to be fitted in rockets with munitions. One known device consists of a trap door, embrittled in certain places and fixed to the rocket shell at other places. The trap door is ejected by the exertion of thrust on the embrittled parts, which are broken and then go out of the rocket fuselage, thus modifying its aerodynamic drag factor (hereinafter designated as Cx), and this difference in Cx partially tears away the trap door.

Unfortunately, a device of this type is not very reliable because pieces of the trap door remain fixed to the rocket shell and could hinder the ejection of the munitions.

SUMMARY OF THE INVENTION

An object of the present invention is a device to close a structure, preferably designed to contain at least one piece of rocket munition, said structure comprising:

a shaped section, made of an elastic material, inside which the edge of the structure and the rim of a lid are embedded in an imperviously sealed way;

means for thrusting the lid outwards from the structure, the thrust being capable of making said rim of the lid and/or said edge of the structure leave the shaped section, preferably through the deformation of this shaped section, and of completely expelling the lid, preferably through a modification of the Cx of the rocket.

The lid of the device is totally expelled, and only the shaped section may possibly remain partially fixed to the structure. The opening of this structure is therefore more efficient than that of the trap door of the known device, giving a substantial advantage in the special case where the device encloses a munitions compartment of a rocket.

More precisely, an object of the invention is a device to close a structure comprising:

a lid;

an elastic shaped section, inside which the edge of said structure and the rim of said lid are embedded in an imperviously sealed way;

means for thrusting said lid outwards from said structure, said thrust being capable of making said rim and/or said edge leave said shaped section, thus causing the complete expulsion of said lid.

BRIEF DESCRIPTION OF THE DRAWINGS

The special features and various embodiments of the invention will emerge from the following description, made with reference to the appended figures, of which:

FIG. 2 showns a partial longitudinal section of the device of FIG. 1;

FIG. 3 showns a partial cross section of a second embodiment of the device according to the invention;

FIG. 4 shows a partial cross section of a third embodiment of the device according to the invention;

These different figures are not drawn to scale, and the same references are repeated for the same elements in all of them.

DESCRIPTION OF PREFERRED EMBODIMENTS

The following description is given as an example in the context of an application of the device according to the invention to the enclosing of a rocket compartment containing munitions.

FIGS. 1 to 4 represent different embodiments of a device according to the invention, fitted, for example, into a rocket, one part of which is cylindrical and has three compartments enclosed by said device. Only one of these compartments, reference 2, is shown in these figures.

Figure 1:
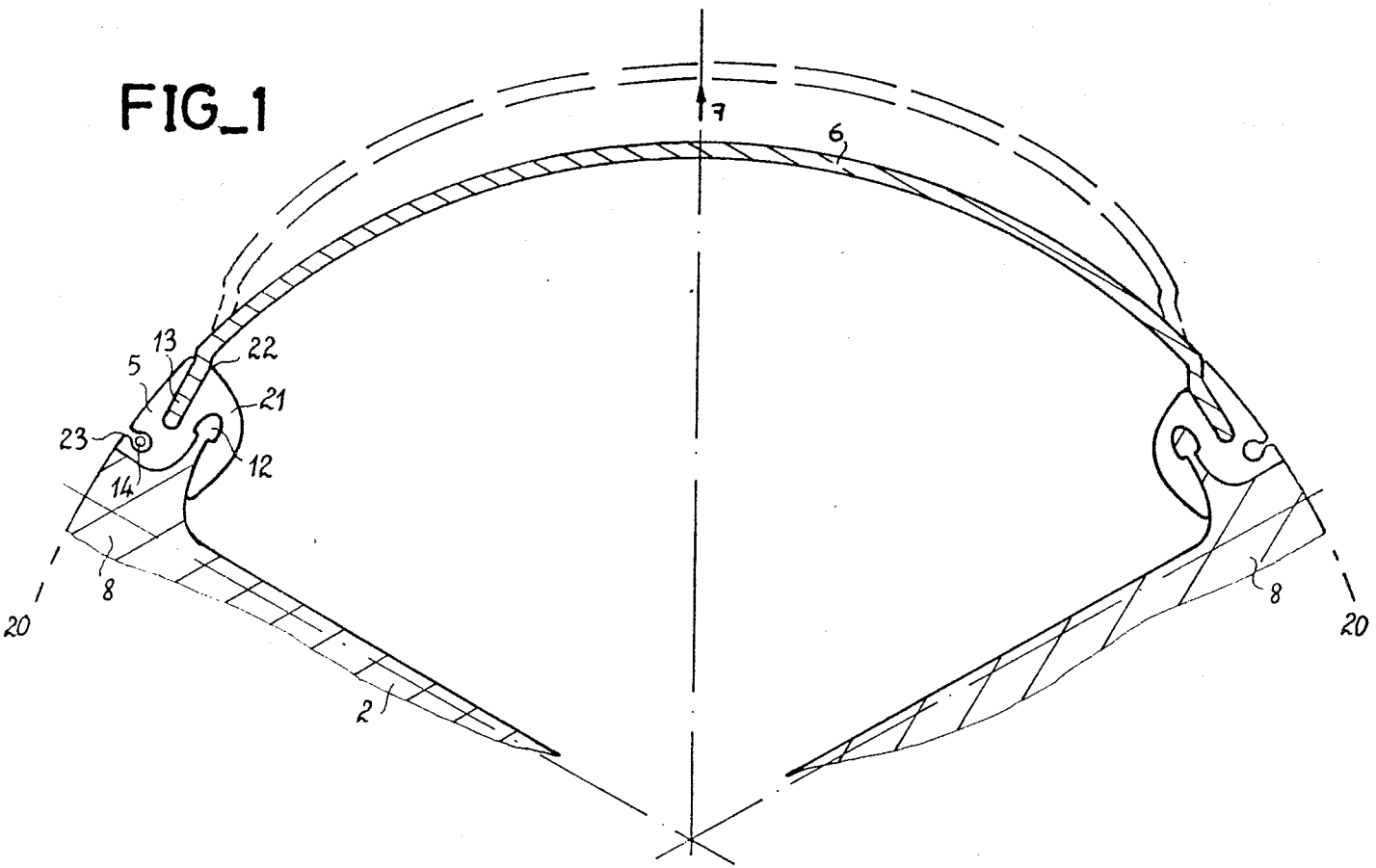
FIG. 1 shows a partial cross section of a first embodiment of the device according to the invention.

FIG. 1 shows a partial cross section of a first embodiment of this type of compartment 2, enclosed by a device comprising:

an elastic shaped section 5, made of an elastomeric material for example;

a cylindrically shaped lid 6 made, for example, of metal or of a composite material;

means for exerting a thrust on the lid 6, outwards from the compartment, said thrusting means being represented schematically by an arrow and being known per se ;

The compartment 2 is closed in the following way:

the edge 8 of the compartment 2 is embedded in the shaped section 5, thus fixing said shaped section 5 to said edge 8;

The compartment 2 can be opened by means of a thrust 7, exerted outwards with respect to the compartment, for example along a line constituting a generatrix of the cylindrical part of the rocket: the thrust 7 makes the lid 6 go out of the shaped section 5. The lid 6 then goes slightly beyond the fuselage 20 of the rocket, modifying the rocket's Cx and thus causing the total expulsion of said lid 6. This thrust 7 may also cause the edge 8 to move partially or completely away from the shaped section 5: the shaped section is then partially or completely torn off and expelled. The thrust 7 can be exerted directly on the lid 6 or by means of the munitions, initially located in the compartment 2, which then press on the inner side of the lid 6.

The device of FIG. 1 can be described more precisely:

the edge 8 of the compartment 2 has a protuberance 12 which is substantially perpendicular to the plane of the section and is substantially parallel to the rocket fuselage 20;

the shaped section 5 has a hollow 21, a slit 22, a hollow 23 which may have a circular cross section for example, the elements 21, 22 and 23 being substantially perpendicular to the plane of the cross-section and substantially parallel to the fuselage 20. The hollow 21 and the slit 22 give the cross section of the elastic shaped section 5 an "S" shape;

the rim 13 of the lid 6 has a shape such that it can be embedded in the shaped section 5 without going beyond the fuselage 20;

this embodiment further has a rigid, transversal rod 14, hereinafter called a "key", which is substantially perpendicular to the plane of the section and substantially parallel to the fuselage 20, said rod having for example a circular cross-section, and being designed to be embedded in the hollow 23, the shape of which is adapted to that of the key 14.

To close the compartment 2:

the protuberance 12 of the compartment 2 is embedded in the hollow 21 of the shaped section 5, thus fastening these two parts rigidly to each other. This fastening may be reinforced with glue.

the rim 13 of the lid 6 is embedded in the slit 22 of the shaped section 5;

this closure is reinforced by means of the key 14, embedded in the hollow 23 of the shaped section 5, thus reducing the elasticity of said shaped section 5.

In the cross section of FIG. 1, dashes are used to show the deformation of the element 6 when the compartment 2 is opened.

FIG. 2 shows a partial longitudinal section of the same elements as those of FIG. 1. The thrust 7 is exerted along the axis A. The description of FIG. 2 is similar to that of FIG. 1. In FIG. 2, the deformation of the element 5 is also shown with dashes.

FIG. 3 shows a partial cross section, similar to that of FIG. 1, of a second embodiment of the device according to the invention. The second embodiment differs from the first one only in that the rim 13 of the lid 6 has a bulge 15 which has a function similar to that of the tightening key 14. The thrust needed to open the compartment 2 is greater in the example of FIG. 3 than in that of FIG. 1. Apart from this, the devices of these two figures both work in the same way.

FIG. 4 shows a partial cross-section, similar to that of FIGS. 1 and 3, of a third embodiment of the device according to the invention. The following are the differences between the device of FIG. 4 and that of FIG. 1:

the protuberance 12 is substantially parallel to a direction D which makes a predetermined angle $\theta$ with the radial wall 25 of the compartment 2;

the elastic shaped section 5 has a hollow 21, a slit 22, a hollow 23, like those of FIG. 1, and further has a shoulder 17 which is itself also substantially perpendicular to the plane of the cross section and substantially parallel to the fuselage 20. This shoulder 17 gives the section of the shaped section 5 no longer an "S" shape but a "E" shape;

the rim 13 of the lid 6 of FIG. 4 is different from that of FIG. 1, its shape being adapted to that of the shaped section 5.

The compartment 2 is closed as follows:

the parts 2 and 5 are fixed with respect to each other as in FIGS. 1 and 3;

the rim 13 of the lid 6 is embedded in the slit 22 of the elastic shaped section 5; the shoulder 17 of the same shaped section 5 is supported in a groove of the lid 6, thus improving the closure of the compartment 2;

this closure is reinforced by the key 14, as in the case of FIG. 1.

The compartment 2 can be opened in the same way as the compartments of FIGS. 1 to 3.

The force of the thrust needed to open the compartment 2 of FIG. 4, which is all the greater as the angle $\theta$ is small, is greater than the force of the similar thrust applied in the example of FIG. 3 which is itself greater than the thrust of the example shown in FIG. 1.

Figure 5:
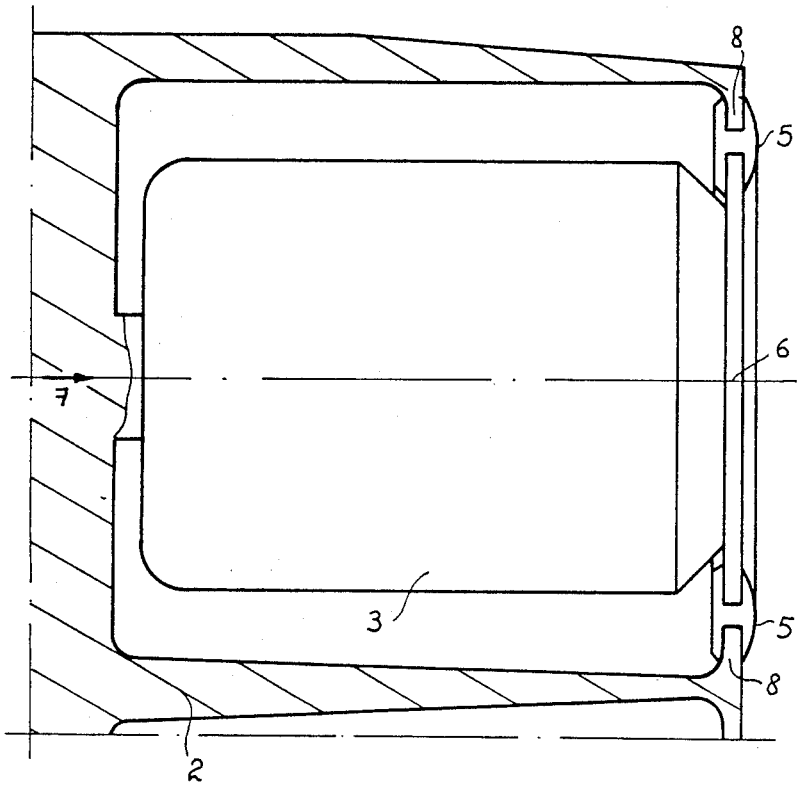
FIG. 5 shows a schematic view of a fourth embodiment of the device according to the invention.

FIG. 5 shows a schematic section of a fourth embodiment of the device according to the invention, where the lid 6 is flat. A compartment 2 containing a piece of munition 3 is closed by a device comprising: an elastic shaped section 5, the lid 6 referred to earlier and means 7 for exerting thrust on the munition 3.

The device of this FIG. 5 functions in the same way as the devices of the previous figures. The thrust 7 is exerted by means of the munition 3.

The device of the invention can withstand high temperature variations. This means that it is possible to comply with temperature standards laid down for military equipment. This is because:

the shaped section 5 remains elastic;

the closure of the compartment 2 remains impervious;

the thermal expansion of the materials constituting the lid 6 or the compartment 2 is reduced through the elasticity of the shaped section 5.

What is claimed is:

1. A missile comprising at least one compartment, said compartment containing at least one munition and being closed by means of a device located at the periphery of said missile, said device comprising:

a lid;

an elastic shaped section, inside which the edge of said compartment structure and the rim of said lid are embedded in an imperviously sealed way;

means for thrusting said lid outward from said structure, said shaped section, under the effect of said thrust, ensuring the separation of said edge from said rim, said separation modifying the aerodynamic drag coefficient of the missile, and causing total expulsion of said lid.

2. A missile according to claim 1, wherein:

said edge has a protuberance;

said shaped section has a first hollow; said protuberance being embedded in said first hollow, an embedding of this type enabling a fixing of said shaped section with said structure.

3. A missile according to claim 2 wherein said shaped section is fixed to said structure also by means of glue.

4. A missile according to claim 1 wherein said shaped section comprises a slit, said rim being embedded in said slit, an embedding of this type enabling a fixing of said lid to said shaped section.

5. A missile according to claim 2 wherein:

said structure has at least one wall;

said protuberance is substantially parallel to a direction forming a predetermined angle with said wall;

said shaped section comprises a slit, said rim being embedded in said slit;

said rim has a groove;

said shaped section has a shoulder which is substantially parallel to the external edge of said lid, resting on said groove; the embedding of said rim in said slit enabling fixation of said lid to said shaped section, and the support of said shoulder in said groove reinforcing the closure of said structure.

6. A missile according to claim 1, wherein said shaped section further comprises a second hollow, said device further comprising a rigid key, said key being embedded in said second hollow, an embedding of this type reinforcing the closure of said structure.

7. A missile according to claim 1, wherein the rim has a bulge, said bulge reinforcing the closure of said structure.

8. A missile having at least one compartment, said compartment containing at least one munition and being closed by means of a device located at the periphery of said missile, said device comprising:

a lid;

an elastic shaped section, inside which the edge of said compartment structure and the rim of said lid are embedded in an imperviously scaled way;

means for thrusting said lid outward from said structure, said shaped section, under the effect of said thrust, ensuring the separation of said edge from said rim, said separation modifying the aerodynamic drag coefficient of the missile, and causing total expulsion of said lid;

said structure having at least one wall;

said protuberance being substantially parallel to a direction forming a predetermined angle with said wall;

said shaped section comprises a slit, said rim being embedded in said slit;

said rim having a groove;

said shaped section having a shoulder which is substantially parallel to the external edge of said lid, resting on said groove; the embedding of said rim in said slit enabling fixation of said lid to said shaped section, and the support of said shoulder in said groove reinforcing the closure of said structure; and wherein said shaped section further comprises a second hollow, said device further comprising a rigid key, said key being embedded in said second hollow, an embedding of this type reinforcing the closure of said structure.

* * * * *